US008761413B2

(12) United States Patent
Ishibashi

(10) Patent No.: US 8,761,413 B2
(45) Date of Patent: Jun. 24, 2014

(54) AUDIO APPARATUS WITH CIRCULARLY ARRANGED MICROPHONES

(75) Inventor: Toshiaki Ishibashi, Fukuroi (JP)

(73) Assignee: Yamaha Corporation (JP)

( * ) Notice: Subject to any disclaimer, the term of this patent is extended or adjusted under 35 U.S.C. 154(b) by 397 days.

(21) Appl. No.: 13/124,815

(22) PCT Filed: Oct. 22, 2009

(86) PCT No.: PCT/JP2009/068166
§ 371 (c)(1),
(2), (4) Date: Apr. 18, 2011

(87) PCT Pub. No.: WO2010/047363
PCT Pub. Date: Apr. 29, 2010

(65) Prior Publication Data

US 2011/0200207 A1 Aug. 18, 2011

(30) Foreign Application Priority Data

Oct. 22, 2008 (JP) ..... 2008-271545

(51) Int. Cl.
*H04R 3/00* (2006.01)
*H04R 9/08* (2006.01)

(52) U.S. Cl.
USPC ..... 381/92; 381/356; 381/361; 381/365; 379/202.01

(58) Field of Classification Search
USPC ..... 379/433.03, 420.01–420.04
See application file for complete search history.

(56) References Cited

U.S. PATENT DOCUMENTS

| | | | | |
|---|---|---|---|---|
| 4,965,775 | A | 10/1990 | Elko et al. | |
| 6,016,346 | A * | 1/2000 | Rittmueller et al. | 379/420.02 |
| 6,275,595 | B1 * | 8/2001 | Lundgren et al. | 381/306 |
| 6,681,023 | B1 | 1/2004 | Turnbull et al. | |
| 8,223,977 | B2 | 7/2012 | Watanabe | |
| 2005/0207566 | A1 | 9/2005 | Ohki et al. | |
| 2007/0297630 | A1 | 12/2007 | Watanabe | |
| 2008/0019551 | A1 | 1/2008 | Watanabe | |
| 2010/0166212 | A1 | 7/2010 | Ishibashi et al. | |

FOREIGN PATENT DOCUMENTS

| | | | |
|---|---|---|---|
| CN | 101133677 | A | 2/2008 |
| EP | 0398595 | A2 | 11/1990 |
| EP | 1965603 | A1 | 12/2006 |
| JP | 2000-253132 | A | 9/2000 |

(Continued)

OTHER PUBLICATIONS

International search report issued in PCT/2009/068166, mailed Dec. 1, 2009.

(Continued)

*Primary Examiner* — Joseph Saunders, Jr.
*Assistant Examiner* — James Mooney
(74) *Attorney, Agent, or Firm* — Rossi, Kimms & McDowell LLP

(57) ABSTRACT

An audio apparatus has a housing including a tub-shaped recessed part having an upper surface and a wall surface formed on the upper surface. Microphones are circularly arranged in the vicinity of the wall surface inside the recessed part. Each microphone face toward a center direction of the recessed part and the upper surface so that a sound pick-up directivity is toward the center of the housing. A back side, opposite to the direction having the directivity of each microphone is open acoustically and is directed toward a direction higher than the wall surface of the tub-shaped recessed part.

4 Claims, 4 Drawing Sheets

(56) References Cited

FOREIGN PATENT DOCUMENTS

| | | | |
|---|---|---|---|
| JP | 2004-80173 | A | 3/2004 |
| JP | 2005-229433 | A | 8/2005 |
| JP | 2007-173922 | A | 7/2007 |
| JP | 2007-174189 | A | 7/2007 |
| JP | 2007-288679 | A | 11/2007 |
| JP | 2008-60939 | A | 3/2008 |
| WO | 99/46956 | A1 | 9/1999 |
| WO | 2006-075377 | A1 | 7/2006 |

OTHER PUBLICATIONS

Japanese Office Action issued in Japanese counterpart application No. JP2008-271545, issued Jul. 24, 2012. English translation provided.

Extended European Search Report issued Jul. 19, 2012 for corresponding EP09822060.

Notification of First Office Action for corresponding CN 200980140474.3, mail date Mar. 29, 2013. English translation provided.

* cited by examiner

AUDIO APPARATUS WITH CIRCULARLY ARRANGED MICROPHONES

This application is a U.S. National Phase Application of PCT International Application PCT/JP2009/068166 filed on Oct. 22, 2009, which is based on and claims priority from Japanese Patent Application No. 2008-271545 filed on Oct. 22, 2008, the contents of which is incorporated herein by reference in its entirety.

TECHNICAL FIELD

The present invention relates to an audio apparatus used for an audio conferencing and, in particular, to an audio apparatus provided with a plurality of microphones.

BACKGROUND ART

When persons discuss with each other on a conference, a sound recorder or an audio conferencing apparatus is mostly placed at a center of conference participants (a center of conference desks, and the like). For example, Patent Literature 1 proposes an audio conferencing apparatus which collects sound of the conference participants existing around the apparatus. In the apparatus as set forth in Patent Literature 1, a recessed part is formed on an upper surface of a disk-shaped housing, and a plurality of microphones are arranged on a bottom surface of the recessed part as viewed from an upper side of the housing. The microphones are arranged on a circle as viewed from the upper side of the housing. Each of the microphones has a unidirectivity and is disposed so that the directivity of the microphone is directed toward a center direction as viewed from the upper side of the housing.

CITATION LIST

Patent Literature

Patent Literature 1: JP2008-60939A

SUMMARY OF INVENTION

Technical Problem

In the apparatus of Patent Literature 1, however, a wall surface of the recessed part of the housing exists at a rear side of each microphone (a direction opposite to a direction having a directivity). A unidirectional microphone has a sensitivity toward only its front side by combining a sound reaching from its back side and a sound reaching from its front side (a direction having a directivity) by means of level adjustment and phase adjustment. Thus, if a housing exists at the back side, the sound reaching from the front side reflects just at the back side, and the sensitivity with respect to the front side is lowered. Accordingly, directivity may be lowered.

Thus, an object of the present invention is to provide an audio apparatus which hardly causes a directivity to be lowered even in a case where a plurality of unidirectional microphones, each having a directivity toward a center of a housing of the apparatus, are embedded in a recessed part provided on an upper surface of the housing.

Solution to Problem

An audio apparatus according to an aspect of the invention includes: a housing including a tub-shaped recessed part which is defined by an upper surface and a wall surface formed on the upper surface; a plurality of directional microphones which are arranged in a circle in the vicinity of the wall surface inside the recessed part, each of the microphones having a directivity directed toward a center direction of the recessed part as viewed from an upper side of the housing and toward the upper surface, and a direction opposite to the direction having the directivity of each of the plurality of directional microphones is open acoustically. Namely, a front side of each microphone is directed toward a bottom surface of the recessed part, and its back side is directed toward a direction higher than the wall surface of the tub-shaped recessed part as viewed from a lateral side of the housing. Note that the shape of the recessed part may be in any form only if the side of the upper surface is open acoustically.

In the aspect, the audio apparatus may further include a plurality of speakers which are arranged in a concentric circle larger in radius than the circle on which the plurality of directional microphones are arranged, and disposed toward a radiation direction of the concentric circle as viewed from the upper side of the housing.

In the aspect, the audio apparatus may be configured in that the direction opposite to the direction having the directivity of each of the plurality of directional microphones is open acoustically by covering a part of the recessed part with a mesh steel sheet.

Advantageous Effects of Invention

According to the invention, a directivity is hardly lowered even in a case where a plurality of unidirectional microphones, each having a directivity toward a center of a housing of the apparatus, are embedded in a recessed part provided on an upper surface of the housing.

DESCRIPTION OF EMBODIMENTS

A description is made of a sound conferencing apparatus provided with microphones and speakers as an embodiment related to an audio apparatus of the invention with reference to the drawings.

Figure 1:
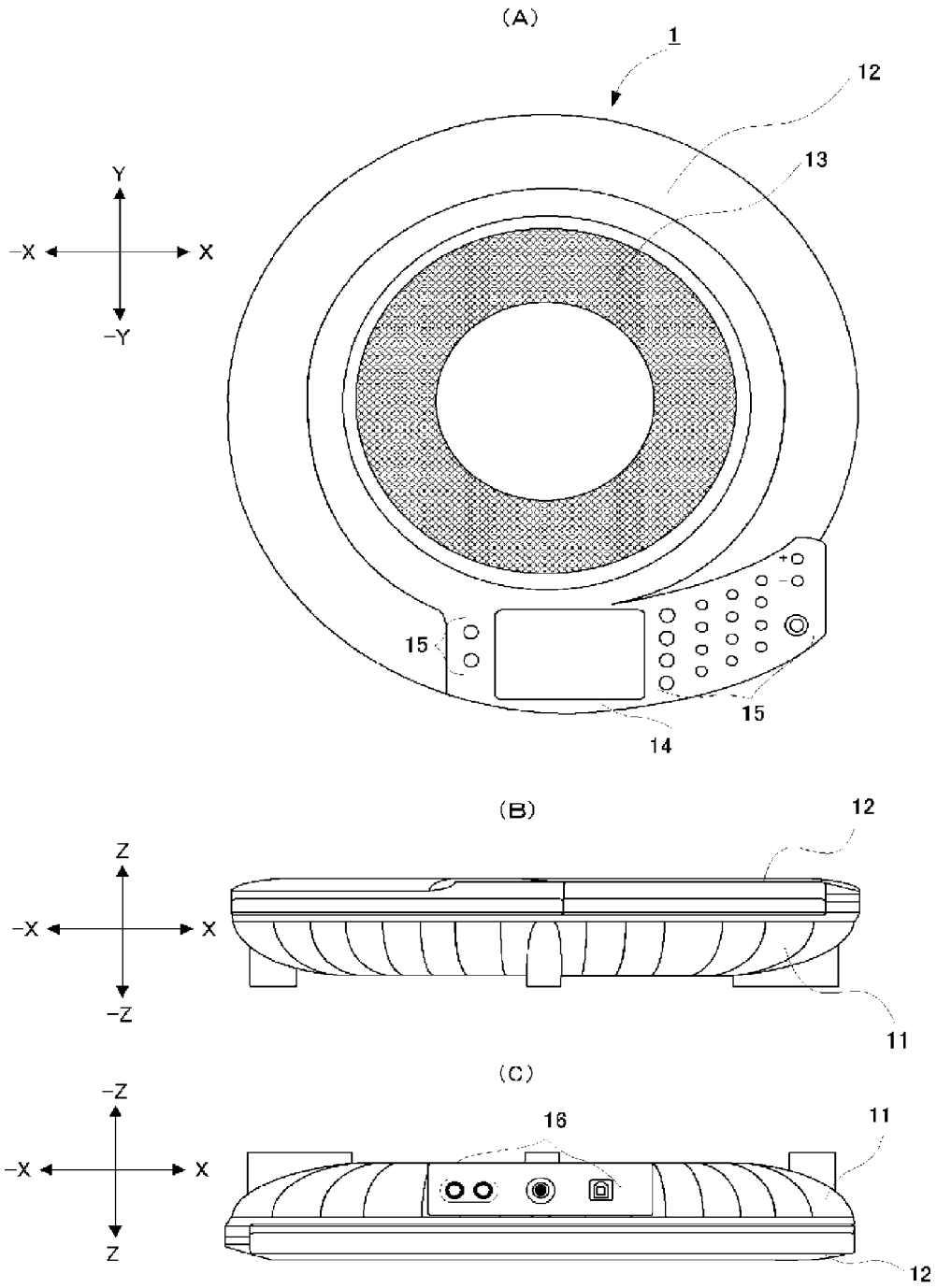
FIG. 1 shows an outer appearance of a sound conferencing apparatus.
Figure 2:
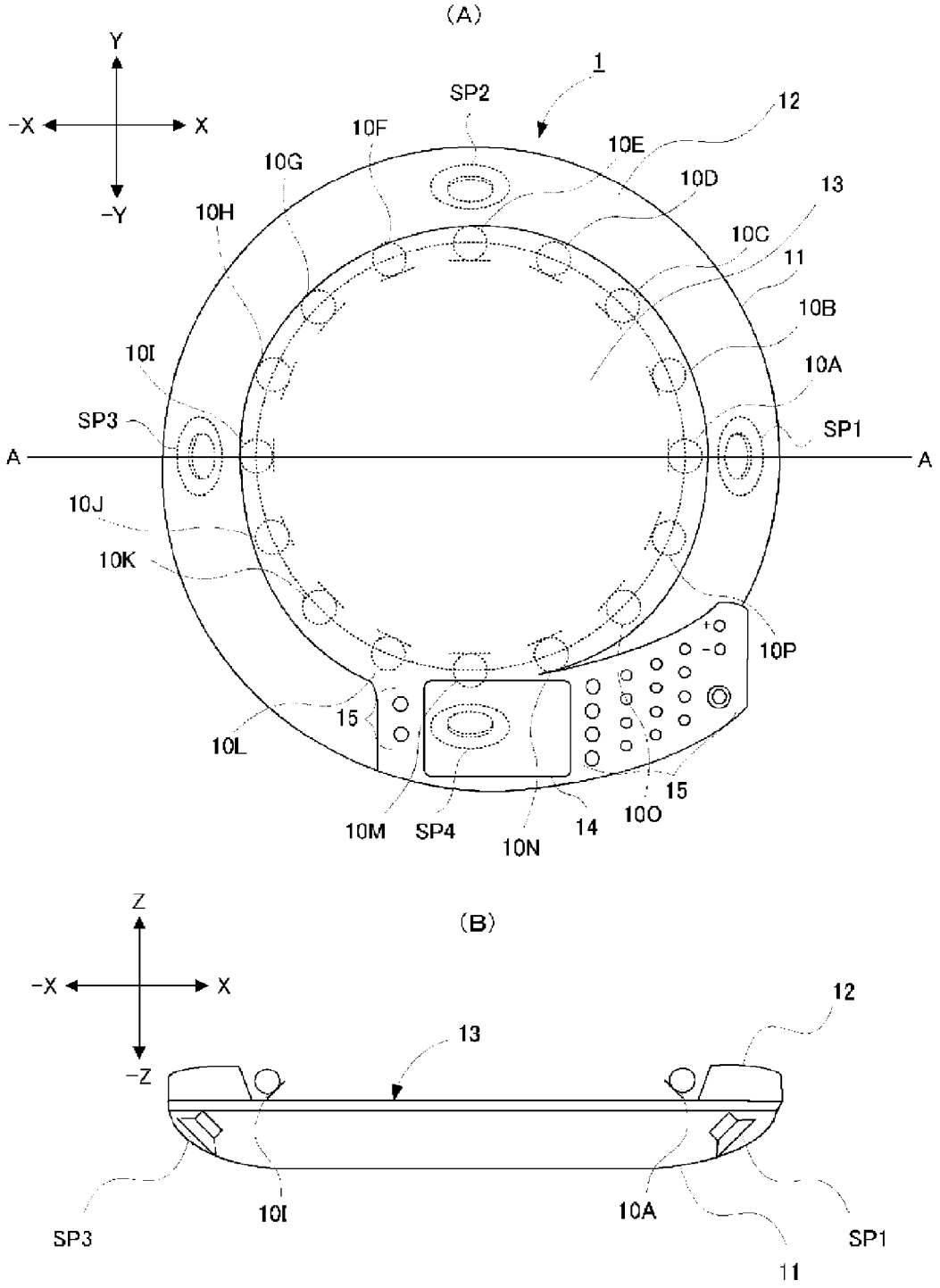
FIG. 2 is a diagrammatic illustration showing an arrangement of microphones and speakers of the sound conferencing apparatus.
Figure 3:
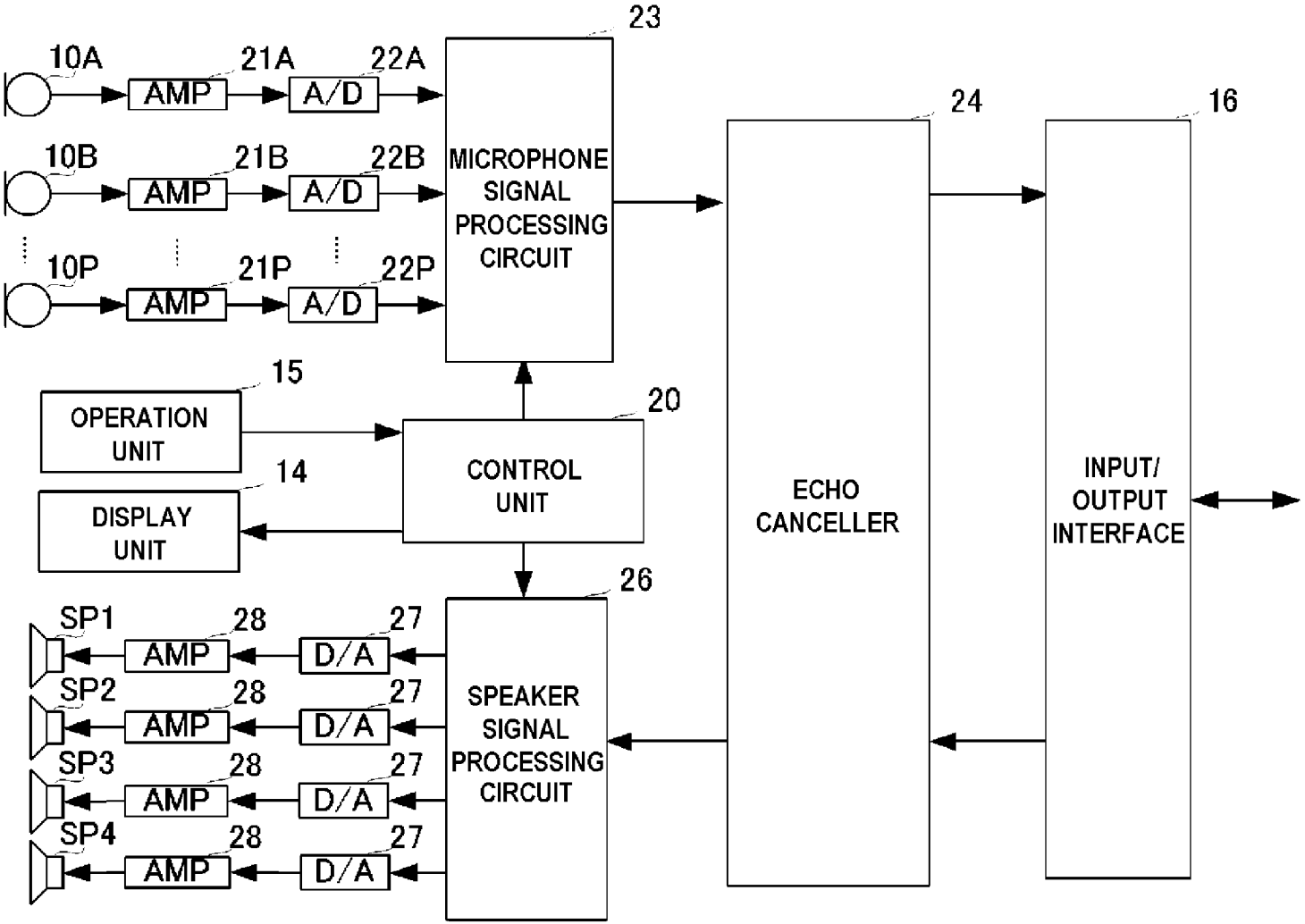
FIG. 3 is a block diagram showing the configuration of the sound conferencing apparatus.

FIG. 1 shows an outer appearance of the sound conferencing apparatus. FIG. 2 is a schematic view showing an arrangement of the microphones and the speakers of the sound conferencing apparatus. FIG. 3 is a block diagram showing the configuration of the sound conferencing apparatus.

(A) in FIG. 1 and (A) in FIG. 2 are plan views of the sound conferencing apparatus, and (B) in FIG. 1 is its front view. (C) in FIG. 1 is a rear view of the sound conferencing apparatus. (B) in FIG. 2 is a cross sectional view taken from line A-A shown by (A) in FIG. 2.

In (A) in FIG. 1 and (A) in FIG. 2, the right side of the sheet refers to an X direction, the left side refers to a −X direction, the top side refers to a Y direction, and the down side refers to a −Y direction. In (B) in FIG. 1 and (B) in FIG. 2, the right side of the sheet refers to the X direction, the left side refers to the −X direction, the top side refers to a Z direction, and the down side refers to a −Z direction. In (C) in FIG. 1, the right side of the sheet refers to the X direction, the left side refers to the −X direction, the top side refers to the −Z direction, and the down side refers to the Z direction.

The sound conferencing apparatus includes a disk-shaped housing 1. The housing 1 includes a dish-shaped lower housing 11 and an upper housing 12 engaged with the lower housing 11 so as to cover an upper surface of the dish-shaped lower housing 11. A recessed part 13 which is recessed in a tub shape is formed on an upper surface of the upper housing 12. The recessed part 13 has a depth (a height of a wall surface) by which microphones can be embedded. A part of the recessed part 13 excluding the vicinity of the center as viewed from an upper side of the housing 1 is covered with a mesh steel sheet. In FIG. 2, indication of the mesh steel sheet is omitted. When the mesh steel sheet is removed, a plurality of microphones are exposed.

In (A) in FIG. 1, a display unit 14 including an LCD and an operation unit 15 including a plurality of operation buttons are arranged at a front side (−Y direction) of the upper housing 12. An input/output interface 16 such as an audio terminal and a USB terminal is arranged at a rear side (Y direction) of the upper housing 12. The display unit 14 displays various information such as a state of the sound conferencing apparatus. The operation unit 15 is an interface provided for accepting the user's operation.

Further, the sound conferencing apparatus includes a plurality of unidirectional microphones (sixteen microphones 10A to 10P in the embodiment) arranged at regular intervals on a circle around a center position of the recessed part 13 on the recessed part.

The microphones 10A to 10P are arranged in the vicinity of the wall surface of the recessed part 13. The respective microphones 10A to 10P are arranged at equiangular intervals (about 22.5° intervals in this embodiment) regarding the center position of the housing 11 as a rotation center as viewed from the upper side of the housing 1. Each microphone is arranged so that its sound-collecting direction (a direction having a high directivity) corresponds to a center direction as viewed from the upper side of the housing 1. The number of microphones is not limited to sixteen, and may be set arbitrarily in accordance with a specification as necessary.

Four speakers SP1 to SP4 are arrange on an inclined surface of the lower housing 11. The respective speakers SP1 to SP4 are arranged at equiangular intervals (about 90° intervals in this embodiment) regarding the center position of the housing 11 as a rotation center as viewed from the upper side of the housing 1. Each speaker is arranged so that its sound-emitting direction corresponds to a radiation direction as viewed from the upper side of the housing 1. Namely, the sound-emitting direction and the sound-collecting direction of the adjacent speaker and microphone (the speaker SP1 and the microphone 10A, for instance) are directions opposite to each other as viewed from the upper side of the housing 1. The speaker and microphone (the speaker SP3 and the microphone 10A, for instance) whose sound-emitting and sound collecting directions are the same direction as viewed from the upper side of the housing 1 are arranged at the positions farthest from each other. Accordingly, the sound fed back from the speaker to the microphone becomes extremely small.

Next, an explanation is made of a sound signal process by the sound conferencing apparatus. As shown in FIG. 3, in addition to the above-configuration, the sound conferencing apparatus includes a control unit 20, AMPs (amplifiers) 21A to 21P, A/D converters 22A to 22P, a microphone signal processing circuit 23, an echo canceller 24, a speaker signal processing circuit 26, four D/A converters 27 and four amplifiers 28.

Sounds collected by the microphones 10A to 10P are input to the amplifiers 21A to 21P. The amplifiers 21A to 21P amplifies outputs the sounds collected by the microphones 10A to 10P respectively, and outputs the amplified sounds to the A/D converters 22A to 22P. The A/D converters 22A to 22P digitally converts the sound signals amplified by the amplifiers 21A to 21P, and outputs the digitally-converted sound signals to the microphone signal processing circuit 23.

The microphone signal processing circuit 23 selects and outputs one signal having the highest sound pressure level among the sound signals output from the A/D converters 22A to 22P. At this time, a process for adding the sounds input from the respective microphones to the sound signal collected by the adjacent microphone may be performed. Addition of the signal collected by the adjacent microphone strengthens the signal in the front direction of the microphone and weakens the signal in directions other than the front direction so as to improve the directivity of the microphone.

An output signal of the microphone signal processing circuit 23 is input to the echo canceller 24. An output signal of the echo canceller 24 is output to another apparatus via the input/output interface 16. The input/output interface 16 outputs a sound signal input from another apparatus to the echo canceller 24. The echo canceller 24 estimates a feedback component reaching from the speakers SP1 to SP4 to the microphones 10A to 10P and subtracts the estimated feedback component from the output signal of the microphone signal processing circuit 23.

The output signal of the echo canceller 24 (a sound signal input from the other apparatus) is output to the speaker signal processing circuit 26. The speaker signal processing circuit 26 divides the sound signal input from the echo canceller 24 in four ways and outputs the divided signals. At this time, the phases of the respective sound signals may be shifted. Phase-shift of the respective sound signals evades causing only the low-frequency component to be emphasized. Thus, the conference participants existing around the apparatus can clearly catch the sounds emitted from the speakers which exist closest to themselves.

The four-way sound signals output from the speaker signal processing circuit 26 are input to the four D/A converters 27 respectively, and converted into the respective analog sound signals. The four-way analog sound signals are amplified by the four amplifiers 28 respectively, and emitted from the respective speakers SP1 to SP4.

In the sound conferencing apparatus according to the embodiment, here, the direction (rear side) opposite to the direction having the directivity of each of the plurality of directional microphones arranged on the upper surface of the recessed part 13 is open acoustically. Since the microphones 10A to 10P are disposed in the vicinity of the wall surface of the recessed part 13, the reflection at the wall surface of the sound reaching from the front side (the direction having the directivity) may cause the directivity to be lowered. For this reason, as shown by (B) in FIG. 2, the front side of each microphone is directed toward a side of a bottom surface of the recessed part 13, and its back side is directed toward a direction higher than the wall surface of the tub-shaped recessed part as viewed from a lateral side of the housing. Although, as mentioned above, each microphone is covered with the mesh steel sheet, it is open acoustically because the mesh steel sheet has little sound insulating properties and little sound absorbability.

Figure 4:
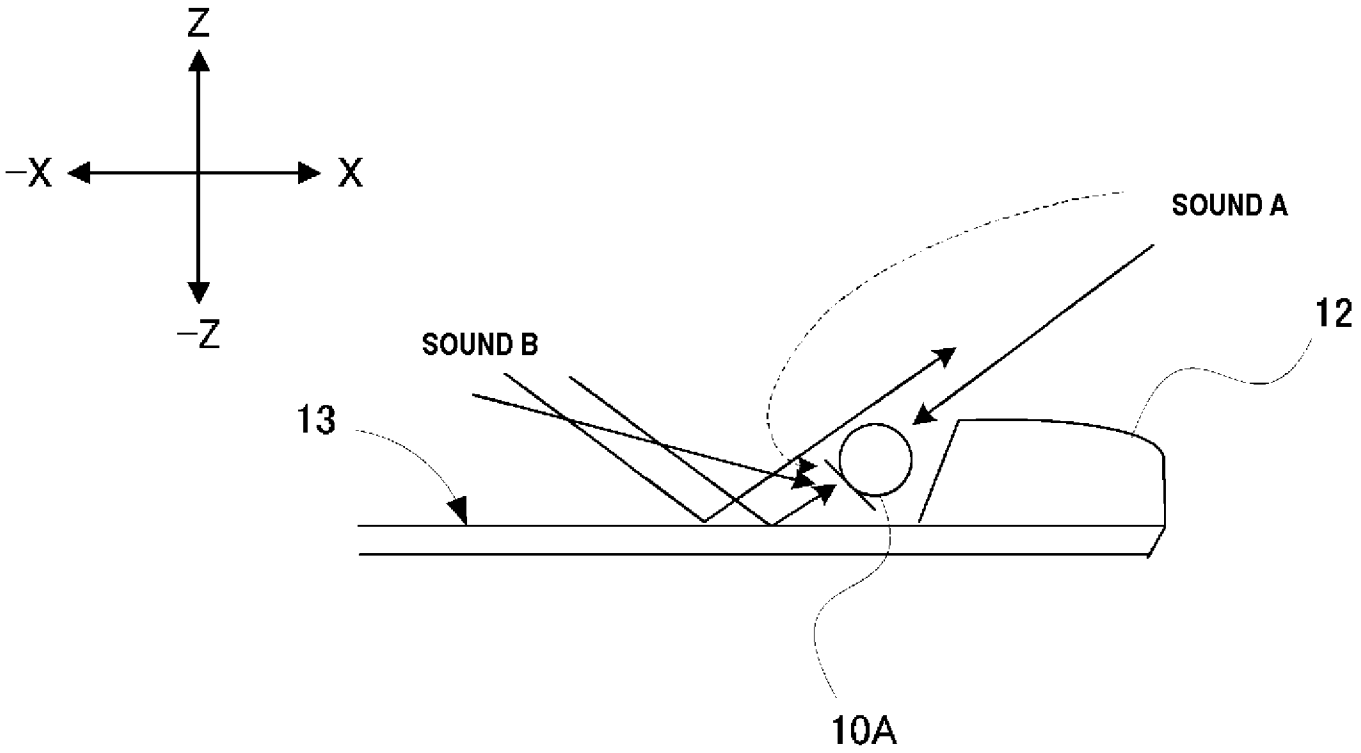
FIG. 4 is an enlarged view showing the arrangement of the microphones.

FIG. 4 is an enlarged view showing the arrangement of the microphone. In FIG. 4, although an explanation is made of the microphone 10A on behalf of the microphones, other microphones have the same configuration and function. Since the conference participants exist around the sound conferencing apparatus, the sound reaches the microphone 10A from obliquely-above as viewed from the lateral side of the housing. In an example of the figure, sound A (as a noise, mainly) from the X, Z direction and sound B (as speech sound of the conference participant) from the −X, Z direction reach the microphone 10A.

Since the microphone 10A is a unidirectional microphone, the sound A is hardly collected. That is, the sound A is cancelled as a result of combining a sound signal collected at the rear side of the microphone 10A and a fed-back sound signal collected at the front side of the microphone 10A. On the other hand, the sound B is collected at the front side of the microphone 10A directly or by reflection on the upper surface of the recessed part 13. Here, since the rear side of the microphone 10A is open acoustically, the sound B is hardly collected from the rear side, and is not also reflected toward the front side. Accordingly, the microphone 10A has a sensitivity only at its front side, and the directivity cannot be lowered (i.e., the unidirectivity is secured).

Further, since the microphone 10A is equivalent to be placed in a position extremely close to the upper surface of the recessed part 13, the sound-collecting sensitivity with respect to the front side is further improved due to the boundary effect.

The sound conferencing apparatus according to the embodiment is configured so that the sound-emitting direction and the sound-collecting direction of the adjacent speaker and microphone (the speaker SP1 and the microphone 10A, for instance) are directions opposite to each other, and therefore, the fed back sound from the speaker to the microphone is extremely small structurally. Further, since the unidirectivity of each microphone is secured due to the arrangement configuration, the fed back sound becomes small furthermore.

Although FIG. 4 shows an example in which the microphone 10A is arranged at an angle of about forty-five degrees, the arrangement angle is not limited to this angle. The microphone 10A may be arranged at any angle only if its rear side is open acoustically.

The embodiment shows an example in which a part of the recessed part 13 is covered with a mesh steel sheet in order to open the back side of the microphone acoustically, but the invention is not limited thereto. For example, the rear side of the microphone may be physically and completely open without providing the mesh steel sheet, or a hole may be formed in a part of the wall surface corresponding to the back side of the microphone, or the like.

In the invention, the configuration of the speakers is not essential. The sound conferencing apparatus can collect the speech sounds in all directions at high S/N ratio even if the sound of the conference is recorded only using the microphones.

The invention claimed is:

1. An audio apparatus comprising:

a housing including a tub-shaped recessed part defined by an upper surface and an annular wall formed on the upper surface;

a plurality of directional microphones circularly arranged along the vicinity of the annular wall inside the recessed part, each of the microphones having a front side directed toward a center direction of the tub-shaped recessed part and downwardly toward the upper surface, wherein a back side of each of the plurality of directional microphones is acoustically open and is directed toward a direction higher than a height of the annular wall.

2. The audio apparatus according to claim 1, further comprising a plurality of speakers arranged concentrically around the plurality of directional microphones and with a main sound output side facing radially outward.

3. The audio apparatus according to claim 1, further including:

a mesh steel sheet that covers part of the recessed part, wherein part of the mesh steel sheet covers the acoustically open back side of each of the plurality of directional microphones.

4. The audio apparatus according to claim 1, wherein each of the plurality of directional microphones is situated lower than a height of the annular wall.

* * * * *